United States Patent [19]

Pasquale

[11] Patent Number: 4,463,895

[45] Date of Patent: Aug. 7, 1984

[54] COVER FOR RECTANGULAR TRAYS

[75] Inventor: William D. Pasquale, Northboro, Mass.

[73] Assignee: New England Envelope Mfg. Co., Worcester, Mass.

[21] Appl. No.: 421,964

[22] Filed: Sep. 23, 1982

[51] Int. Cl.[3] ..... B65D 5/42

[52] U.S. Cl. ..... 229/49; 217/69; 229/30; 229/32

[58] Field of Search ..... 229/49, DIG. 2, 30, 229/32, 41 R, 41 B; 217/69; 24/288, 297, 349, 237, 155 BB; 52/357-360, 489, 582, 586

[56] References Cited

U.S. PATENT DOCUMENTS

| | | | |
|---|---|---|---|
| 276,993 | 5/1883 | Arnold | 24/155 BB |
| 663,134 | 12/1900 | Simon | 229/49 |
| 869,833 | 10/1907 | Ferres | 229/49 |
| 959,734 | 5/1910 | Hall | 229/49 |
| 1,048,031 | 12/1912 | Bradley | 229/49 |
| 1,926,366 | 9/1933 | Bergstein | 229/31 R |
| 2,650,751 | 9/1953 | Goers | 229/31 R |
| 2,692,722 | 10/1954 | Johnson | 229/45 R |
| 2,772,559 | 12/1956 | Morrell | 24/237 X |
| 3,226,008 | 12/1965 | Chiorri | 229/49 |
| 3,386,644 | 6/1968 | Zackheim | 229/41 B |
| 3,904,066 | 9/1975 | Wilson | 229/30 X |
| 4,164,313 | 8/1979 | Hewitt | 229/31 R |

FOREIGN PATENT DOCUMENTS

| | | | |
|---|---|---|---|
| 107147 | 1/1961 | Denmark | 229/49 |

*Primary Examiner*—William Price
*Assistant Examiner*—Gary E. Elkins
*Attorney, Agent, or Firm*—Blodgett & Blodgett

[57] ABSTRACT

Box cover formed from corrugated material, including a top panel and four edge and side panels forming an enclosure, the corners being held together by a resilient clip.

6 Claims, 6 Drawing Figures

COVER FOR RECTANGULAR TRAYS

BACKGROUND OF THE INVENTION

In the shipping of paper goods, such as envelopes, it is good practice to make use of a corrugated board tray which can be erected from a flat blank. This is because, after the envelopes have been used, the tray can be dismantled and stored or returned to the envelope manufacturer. It has been found that these open top trays sometimes allow dust and dirt to fall into the contents and sometimes they are even subjected to rain and snow. For that purpose, it would be desirable to provide a cover to extend over the top of a tray or a group of trays to protect the contents. Such a cover can also serve to lock together a plurality of trays, so that they can be handled as a unit. In the optimum case, such a cover would be constructed so that it could be dismantled and shipped back in flat form also. Attempts in the past to provide such a cover have been less than successful, primarily because of the high cost and because of the fact that the prior art constructions have been relatively intricate and fragile. These and other difficulties experienced with the prior art constructions have been obviated in a novel manner by the present invention.

It is, therefore, an outstanding object of the invention to provide a cover for a rectangular tray, which cover is capable of being disassembled and shipped in flat form.

Another object of this invention is the provision of a reusable cover formed of corrugated material, the cover having no elements that are easily damaged during shipment.

A further object of the present invention is the provision of a cover having a top panel and four walls for completely protecting an open tray or unitizing a plurality of trays.

It is another object of the instant invention to provide a cover for an open tray which is simple in construction, which is inexpensive to manufacture, and which is capable of repeated use with a minimum of care in its shipment.

With these and other objects in view, as will be apparent to those skilled in the art, the invention resides in the combination of parts set forth in the specification and covered by the claims appended hereto.

SUMMARY OF THE INVENTION

In general, the invention consists of a box cover having a rectangular top panel, having two opposed end walls, each hingedly connected to the top panel at an end edge thereof, and having two opposed side walls, each hingedly connected to the top panel at a side edge thereof. A triangular panel is hingedly connected to each end edge of each of the end and side walls and is folded back against and fastened to the adjacent inner surface of its respective wall. A U-shaped clip joins adjacent walls and holds them in an erected position perpendicular to the top panel.

Specifically, the top panel, the side walls, and the end walls are integrally formed of corrugated material. The U-shaped clip having the legs located either in an open corrugation or in the fold between a wall and a triangular panel.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
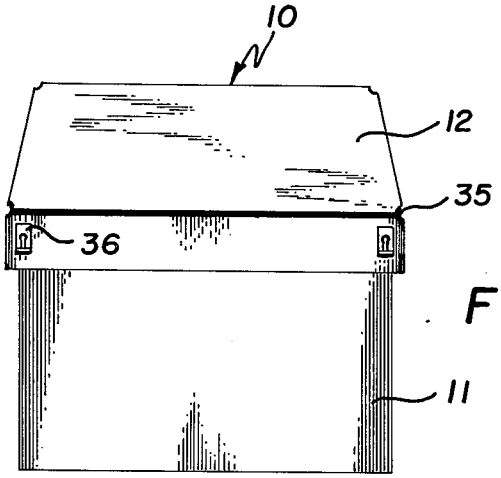
FIG. 1 is a perspective view of a cover incorporating the principles of the present invention, the cover being shown in use with an open-topped tray.

Referring first to FIG. 1, which best shows the general features of the invention, the cover, indicated generally by the reference numeral 10, is shown in use with an open top tray 11. This tray may be of the type shown in the patent of Hewitt U.S. Pat. No. 4,164,313 which is generally intended for the shipment of envelopes and the like. As is evident in the drawing, the cover is provided with a large rectangular top panel 12.

Figure 2:
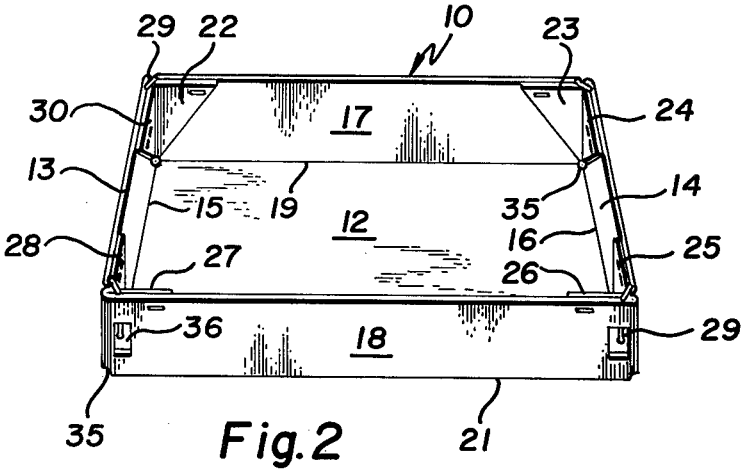
FIG. 2 is a perspective view of a cover in upside-down position.

Referring next to FIG. 2, it can be seen that the cover 10 consists of a rectangular top panel 12 and two opposed end walls 13 and 14 which are hingedly connected to the top panel 12 at end edges 15 and 16, respectively, thereof. Two opposed side walls 17 and 18 are each hingedly connected to the top panel 12 at side edges 19 and 21, respectively, thereof. A triangular panel 22 is hingedly connected to the end edge of the side wall 17 and is folded back against that wall and fastened thereto by a large staple or the like. Triangular panels 23, 24, 25, 26, 27, 28, and 30 are associated with the other side and end walls. In other words, a triangular panel is hingedly connected to each end edge of each of the end and side walls, each triangular panel being folded back against and fastened to the adjacent inner surface of its respective wall. A U-shaped clip 29 joins adjacent walls and holds them perpendicular to the top panel 12.

Figure 3:
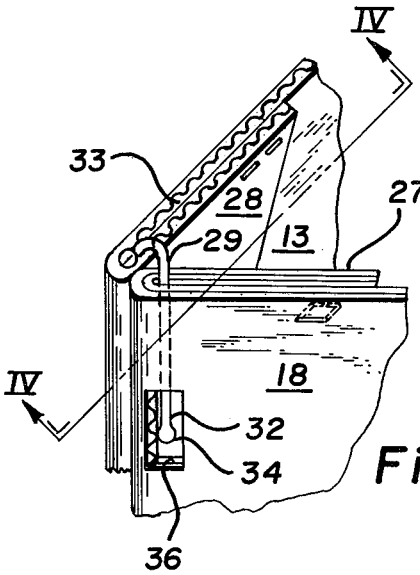
FIG. 3 is an enlarged perspective view of a corner portion of the cover.
Figure 4:
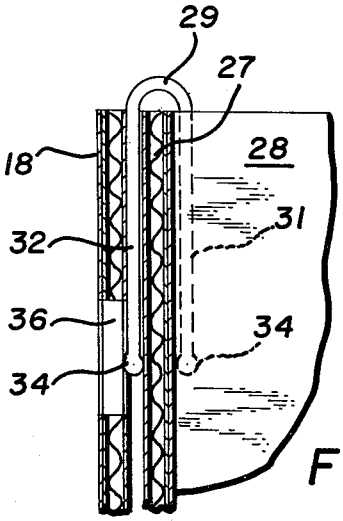
FIG. 4 is a sectional view of the cover, taken on the line IV—IV of FIG. 3.

As is best evident in FIGS. 3 and 4, the top panel, the side walls, and the end walls are integrally formed of corrugated material, leaving exposed ends 33 of the corrugations at the upper edge of the end walls 13 and 14. The U-shaped clip 29 has one leg 31 in an open corrugation and the other leg 32 in the fold between the wall 18 and the triangular panel 27. The clip 29 in each corner is similarly associated with the walls that it joins.

The corrugations extend parallel to the side edges 19 and 21 of the top panel, so that the ends 33 of the corrugation are exposed on the end walls 13 and 14 to receive one leg 34 of the clip 29. It is evident in FIG. 3 the sides of the corrugations are exposed in the side wall 18 and the other leg 32 of the clip resides in the fold formed by the junction between the side wall 18 and its triangular panel 27. A window 36 is formed in the side wall 18 to expose the lower end of the leg 32 of the clip to assist in its removal. The U-shaped clip 29 is formed of plastic with a smooth enlargement 34 at the end of each of the legs. An aperture 35 is provided at each of the junctions between the top panel 12 and each pair of adjacent side and end walls.

Figure 5:
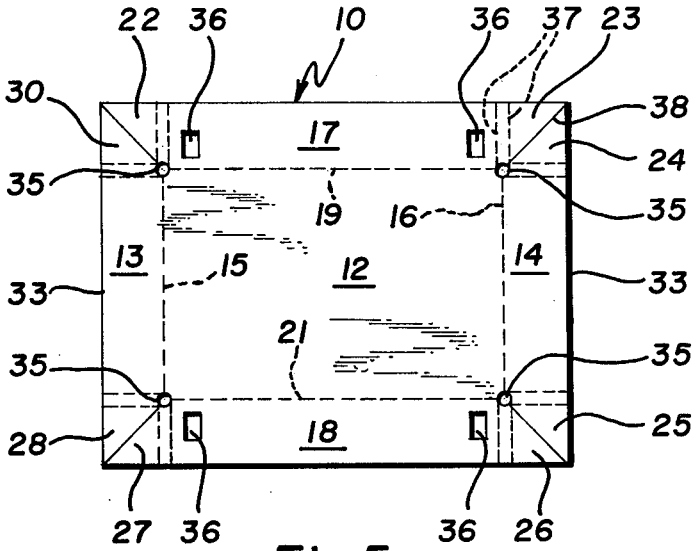
FIG. 5 is a top plan view of a blank used in forming the cover.

As is evident in FIG. 5, the cover is formed from a blank in the form of a single sheet of corrugated material. Two opposed end edges and two opposed side edges define a rectangular which is the overall shape of the blank. Two opposed end score lines 15 and 16 and two opposed side score lines 19 and 21 are located inwardly of the said end and side edges, respectively, and serve to define a centrally-located rectangular. The circular aperture 35 is located at the junction of each side score line 19 and 21 with the end lines 15 and 16.

A pair of closely-spaced parallel score lines 37 extend from each aperture 35 to the adjacent side edge and end edge at right angles thereto. A cut 38 extends from each aperture 35 to the corner formed by the adjacent side edge and end edge. The window 36 is formed adjacent each aperture 35 and is located in the quadrant formed by a side score line and the adjacent pair of parallel score lines.

Figure 6:
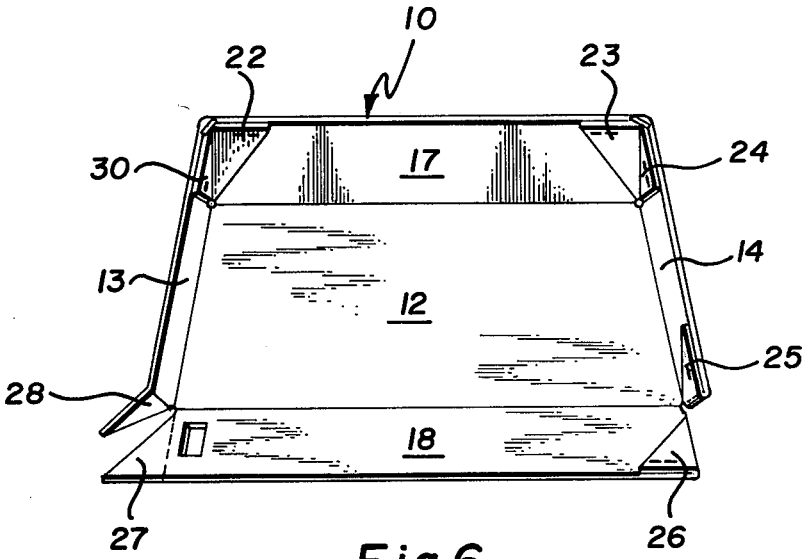
FIG. 6 is a perspective view of the cover during assembly from the blank.

The operation and the advantages of the present invention will now be readily understood in view of the above description. Starting with the blank shown in FIG. 5, the first step in setting up the cover 10 is to fold the triangles 22, 23, 24, 25, 26, 27, 28, and 30 back against their adjacent side and end walls, respectively. Each triangular is formed, of course, by the cut 38 and the parallel score lines 37. Folding is facilitated by the presence of the aperture 35. It will be noted that, when the triangular panel is folded back, it serves to cover the window 36 on the inner surface; in this way dust and the like cannot enter the cover through the window. FIG. 6 shows (in the lower left hand corner) the manner in which the triangles 27 and 28 are bent from their position in the plane of the top panel 12 toward their respective end and side walls. In the lower right hand side of FIG. 6, the triangles 25 and 26 are shown stapled to their end wall 14 and side wall 18, respectively. At the rear of FIG. 6, the clip 29 is shown in place holding the walls in their erected position.

The completed cover (which is shown in FIG. 2) can be applied to the tray 11 (as shown in FIG. 1) or can be made very large, so that it serves to cover more than one of the trays 11. Since the main purpose of the cover is to protect the contents of the tray during shipping and storage, the cover can be applied to more than one tray and still obtain the same advantages. When it is necessary to collapse the tray, the person performing the dissassembly operation inserts his finger through the window 36 and presses upwardly on the enlarged smooth protuberance 34 at the bottom of the leg 32. The clip rises high enough to be grasped at the top and pulled from its locking position. Once all of the clips have been removed, the sides are bent back, resulting in a flat device which can be stacked with other similar covers and are shipped or stored as appears to be necessary.

It can be seen, then, that the result of the present invention is an inexpensive, simple cover which serves its purpose and, yet, which can be easily stored and shipped without including a great deal of bulk. Also, the structure used is so simple that the cover is capable of extensive use before it deteriorates badly enough to be useless and needs to be discarded.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Cover for a rectangular tray, comprising:

(a) a rectangular top panel, (b) two opposed end walls, each hingedly connected to the top panel at an end edge thereof, (c) two opposed side walls, each hingedly connected to the top panel at a side edge thereof, (d) a triangular panel hingedly connected to each end edge of each of the end and side walls and folded back against and fastened to the adjacent inner surface of its respective wall, and (e) a U-shaped clip having two legs, each leg having a lower end, the clip joining adjacent walls and holding them perpendicular to the top panel, wherein a window is formed in one of the walls adjacent to each clip to expose the lower end of one of the legs of the clip to assist in its removal.

2. Cover as recited in claim 1, wherein an aperture is provided at each of the junctions between the top panel and each pair of adjacent side and end walls.

3. Blank formed of a single sheet of corrugated material, the blank being used as a cover for at least one open-topped tray, comprising:

(a) two opposed end edges and two opposed side edges defining a rectangle, (b) two opposed end score lines and two opposed side score lines located inwardly of the said end and side edges and defining a centrally-located rectangle, (c) a circular aperture located at the junction of each end score line and side score line, (d) a pair of closely-spaced, parallel score lines extending from each aperture to the adjacent side edge and end edge at right angles thereto, (e) a cut extending from each aperture to the corner formed by the adjacent side edge and end edge, and (f) a window formed adjacent each aperture and located in the quadrant formed by a side score line and the adjacent pair of parallel score lines.

4. Cover for a rectangular tray, comprising:

(a) a rectangular top panel, (b) two opposed end walls, each hingedly connected to the top panel at an end edge thereof, (c) two opposed side walls, each hingedly connected to the top panel at a side edge thereof, (d) a triangular panel hingedly connected to each end edge of each of the end and side walls and folded back against and fastened to the adjacent inner surface of its respective wall, and (e) a U-shaped clip joining adjacent walls and holding them perpendicular to the top panel, wherein the top panel, the side walls, and end walls are integrally formed of corrugated board, and wherein the U-shaped clip has one leg in an open corrugation and the other leg in the fold between a wall and a triangular panel;

wherein the corrugations extend parallel to the side edges of the top panel, whereby the ends of the corrugations are exposed on the end wall to receive one leg of the clip and the sides of the corrugations are exposed in the adjacent side wall, so that the other leg of the clip resides in the fold joining the said side wall and its triangular panel; and wherein a window is formed in the side wall to expose the lower end of the said other leg of the clip to assist in its removal.

5. Cover as recited in claim 4, wherein the U-shaped clip is formed of plastic with smooth enlargements at the ends of the legs.

6. Cover as recited in claim 5, wherein an aperture is provided at each of the junctions between the top panel and each pair of adjacent side and end walls.

* * * * *